United States Patent [19]

Giori

[11] 4,283,902

[45] Aug. 18, 1981

[54] PROCESS AND APPARATUS FOR CONVERTING PILES OF FRESHLY PRINTED SHEETS OF BANK-NOTES INTO BUNDLES OF BANK-NOTES

[75] Inventor: Gualtiero Giori, Lonay, Switzerland

[73] Assignee: De la Rue Giori, S.A., Lausanne, Switzerland

[21] Appl. No.: 67,549

[22] Filed: Aug. 17, 1979

Related U.S. Application Data

[63] Continuation of Ser. No. 868,747, Jan. 12, 1978, abandoned.

[30] Foreign Application Priority Data

Jan. 19, 1977 [CH] Switzerland ..... 638/77

[51] Int. Cl.[3] ..... B65B 27/08; B65B 13/02; B65B 61/06

[52] U.S. Cl. ..... 53/399; 53/435; 53/520; 53/591

[58] Field of Search ..... 53/399, 435, 520, 589, 53/522, 591

[56] References Cited

U.S. PATENT DOCUMENTS

| | | | |
|---|---|---|---|
| 1,750,059 | 3/1930 | Selden | 53/589 X |
| 3,106,809 | 10/1963 | Forthmann | 53/520 X |
| 3,347,136 | 10/1967 | Kure | 53/520 X |
| 3,939,621 | 2/1976 | Giori | 53/520 |
| 3,982,453 | 9/1976 | D'Amato et al. | 53/520 X |
| 4,045,944 | 9/1977 | Giori | 53/520 |

*Primary Examiner*—Horace M. Culver

*Attorney, Agent, or Firm*—Robert E. Burns; Emmanuel J. Lobato; Bruce L. Adams

[57] ABSTRACT

Piles of freshly printed sheets of multiple bank-notes are cut into bundle strips and then these bundle strips are cut into individual bundles of bank-notes; a band station is located between the cutting unit cutting the piles of sheets into bundle strips and the cutting unit cutting these bundle strips into bundles of bank-notes and comprises as many banding device operating in synchronism and located in one row as there are individual bank-notes per strip, so that the bundles of each strip are banded before this strip is cut into bundles.

17 Claims, 1 Drawing Figure

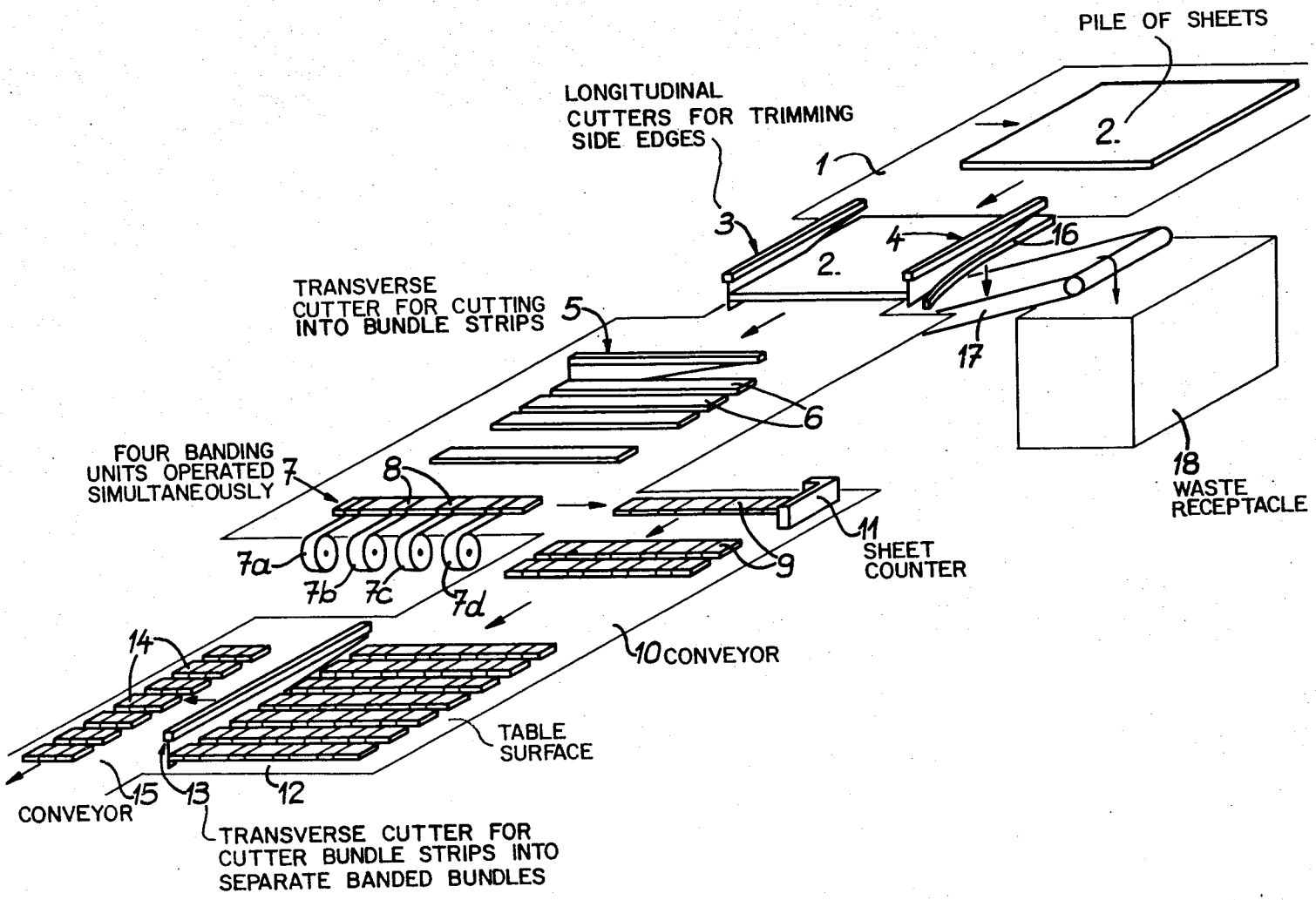
PILE OF SHEETS
2.
LONGITUDINAL CUTTERS FOR TRIMMING SIDE EDGES
1
2.
3
4
16
17
18 WASTE RECEPTACLE
TRANSVERSE CUTTER FOR CUTTING INTO BUNDLE STRIPS
5
6
SHEET COUNTER
11
9
10 CONVEYOR
FOUR BANDING UNITS OPERATED SIMULTANEOUSLY
7
7a
7b
7c
7d
8
TABLE SURFACE
12
TRANSVERSE CUTTER FOR CUTTER BUNDLE STRIPS INTO SEPARATE BANDED BUNDLES
13
14
15
CONVEYOR

PROCESS AND APPARATUS FOR CONVERTING PILES OF FRESHLY PRINTED SHEETS OF BANK-NOTES INTO BUNDLES OF BANK-NOTES

This is a continuation, of application Ser. No. 868,747, filed Jan. 12, 1978 and now abandoned.

FIELD OF INVENTION

The invention relates to process and apparatus for converting piles of freshly printed sheets of security papers having a plurality of bills printed thereon, in particular sheets of multiple bank-notes, into bundles of bills surrounded by a band.

BACKGROUND OF THE INVENTION

An apparatus of this type for converting freshly printed sheets of security papers as bank-notes is known, in which the pile of sheets formed at the outlet of the numbering machine is cut stepwise automatically into individual bundles of finished single security papers or bills having the correct format, and each individual bundle is then surrounded by a band.

For this purpose, the piles of sheets, which generally each contain one hundred sheets in the correct sequence of numbers, are supplied manually or automatically to the feed device of a cutting station by means of a conveying device receiving the pile of sheets at the outlet of the numbering machine. In a first longitudinal cutting unit, the edges of the sheets are cut on one side of each pile of sheets arranged in the feed direction, the direction of travel of which pile is then changed by 90°, so that the side of the pile located opposite the cut edge now becomes the new front side. A second cutting unit firstly cuts the edges on this front side of the pile of sheets and then divides this pile of sheets into bundle strips by subsequent cuts. A third longitudinal cutting unit then cuts the edge on a short side of each bundle strip located in the conveying direction, which bundle strip then changes its conveying direction by 90° such that the short side located opposite the edge cut last now becomes the front side. Finally, a fourth transverse cutting unit firstly cuts this front side of each bundle strip and then divides the bundle strip by subsequent cuts into individual bundles of bank-notes. These bundles of bank-notes then pass one behind the other at a distance apart to a banding station, in which they are surrounded individually one after the other by a band.

The finished bound bundles of bank-notes are then made into packs of bank-notes, which generally comprise ten bundles each with one hundred bank notes, i.e. one thousand bank notes in all.

If, when producing the packs of bundles, the sequence of numbers of the bank-notes is to be preserved, then corresponding sorting of the bundles of bank-notes is necessary before they are packed in packs, because as a rule, the sequence of numbers within one bundle is not a continuation of the sequence of numbers in the preceding bundle. Numbering machines for sheets of multiple bank-notes generally operate such that identical bank-note positions on successive sheets are numbered in succession, whereas the bank-note positions on one and the same sheet can be distinguished by the serial number or the higher places of the numbers. Therefore, if twenty eight bank-note positions are provided on one sheet of bank-notes for example, that is to say seven rows each with four printed bank-notes, then for the subsequent packing of ten bundles of bank-notes, the first, the twenty ninth, the fifty seventh etc. then the second, the thirtieth, the fifty eighth etc. must be combined in order to obtain packs each with one thousand consecutively numbered bank-notes, which belong to a specific series of one thousand notes. An automatic apparatus is already known for this sorting operation, before packing the bundles of bank-notes.

Furthermore, it is customary for an inspector to check the freshly printed sheets of bank-notes for printing errors, before they are cut up and to provide each faulty printed bank-note with a mark for the purpose of subsequent elimination. The afore-mentioned known apparatus for converting sheets of bank-notes is arranged so that the bound individual bundles pass a detector system, which responds to the afore-mentioned marks and that furthermore, a removal device controlled by the fault signal of this detector system is provided, which removes the bundles of bank-notes containing at least one incorrectly printed note, from the conveying arrangement. A detector system of this type may operate inductively for example and in this case it is desirable to choose a marking material which varies the inductive properties of the bank-note accordingly. The empty space formed in the conveying sequence by the elimination of a bundle of bank-notes can be filled by a satisfactory bundle of bank-notes before the formation of the packs of bundles to be packed. This bundle of bank-notes which is inserted may be a replacement bundle with satisfactory bank-notes. However, the bundle of bank-notes eliminated may travel through a bank-note-exchange station, in which each individual faulty bank-note is replaced by a satisfactory numbered replacement bank-note. Subsequently, this re-formed bundle of bank-notes can be re-inserted at the correct point in the conveying sequence, before the banding or packing station for the packs of bundles.

Now according to experience, the capacity of such an apparatus for converting freshly printed sheets of bank-notes, operating largely automatically, is limited substantially by the maximum possible operating speed of the banding station for the individual bundles of bank-notes. At least two seconds are necessary for wrapping the band around the bundle of bank-notes and for reliable sticking of the latter, which period of time cannot be reduced in practice. This means that with the afore-described known apparatus, at best, approximately thirty bundles per minute, or, since a bundle generally contains one hundred bank-notes, approximately 180,000 bank-notes per hour can be handled.

However, modern printing and numbering machines for bank-notes recently have an output of 8,000 to 10,000 sheets per hour. If each sheet contains fifty individual notes, then these machines facilitate the production of 400,000 to 500,000 bank-notes per hour, which corresponds to approximately sixty six to eighty three bundles of bank-notes per minute, presupposing that each bundle contains one hundred bank notes. Since the known apparatus is only able to handle thirty bundles per minute at the maximum, only half the full capacity of modern rotary printing machines can therefore be used in conjunction with the known apparatus for converting the sheets of bank-notes.

SUMMARY OF THE INVENTION

The invention intends to increase the capacity or output of an apparatus of the known type, i.e. the number of finished bound bundles of bank-notes produced per unit time.

The invention is therefore based on an apparatus for converting piles of freshly printed sheets of multiple bank-notes into bound bundles of bank-notes, by cutting units by which the piles of sheets are cut into bundle strips and then these bundle strips are cut into individual bundles of bank-notes, with a banding station for the bundles of bank-notes and with conveying sections connecting the cutting units and the banding station, for conveying the piles of sheets, bundle strips or bundles of bank-notes.

To solve the aforesaid object, this apparatus is characterized according to the invention in that the banding station is located between the cutting unit cutting the pile of sheets into bundle strips and the cutting unit cutting these bundle strips into bundles of bank-notes and there are as many banding devices located in one row and operating simultaneously as there are individual bank notes per strip.

In this way, the bundle strips are simultaneously provided with bands at all bank-note positions, so that the bundles of bank-notes leaving the last cutting tool are already bound and the narrow path which the banding station represented in the apparatus known hitherto, is eliminated. This provides the advantage that the apparatus can be readily adapted to the full capacity of modern printing and numbering machines and banding devices can be used simultaneously, which do not need to be designed for the maximum operating speed which is possible in principle. One can thus proceed on the assumption that today most sheets of bank-notes produced have at least four bank-notes per row, so that four subsequent bundles of bank-notes are always bound simultaneously per bundle strip. Therefore, in this case, if one provides a working cycle of approximately four seconds for the banding devices, compared with the known apparatus, one obtains twice the capacity of approximately sixty bundles of bank-notes per minute, in which case the necessary working speed of the banding devices, is simultaneously only approximately half as great as the maximum possible speed. Due to this, the wear and susceptibility to breakdown of the banding devices is reduced and their maintenance is simplified. If necessary, they may also be constructed in a more simple manner.

Since, at present and in all probability also in the future, the requirement for new bank-notes to be issued world-wide is increasing and will increase greatly, especially since the smaller values previously issued in the form of coins are frequently replaced by notes, the acceleration in the handling of freshly printed bank-notes and in particular the adaptation to the full capacity of modern note-printing machines and numbering machines, achieved by the apparatus according to the invention, is extraordinarily important. Thus, for example, sheets which have ten rows each with five bank-notes, i.e. fifty individual notes and are converted into customary piles each of one hundred notes, can be converted so quickly using a banding station with five banding devices operating with a cycle of four seconds that approximately seventy five finished bound bundles are produced per minute, which corresponds to a capacity of 450,000 bank-notes or 9,000 sheets per hour. A further advantage consists in that the finished bank-notes cut to the desired format are accessible to the operators only in the form of bound bundles, which virtually precludes possible theft of individual bank-notes. This increase in security is particularly important when handling bank-notes.

In order to prevent the last cutting tool dividing the bundle strips from having to operate with an unfavourably high cuting rhythm, according to a further feature of the invention, the arrangement is preferably such that several bound bundle strips, preferably all the bundle strips belonging to one original pile of sheets arrive in front of this last cutting unit in rows side-by-side and this cutting unit with a cutter of adequate length cuts all these bundle strips simultaneously, at the time of each cut. This simultaneous cutting of several separate bundle strips is facilitated due to the fact that according to the invention, each bundle strip is already held together by several bands. With particular reference to the packing of bound bundles in packs, whilst preserving the sequence of numbers, it is appropriate to divide all the bundle strips belonging to an original pile of sheets simultaneously. Thus, during each cutting operation, the number of bundles produced is the same as the number of rows of notes on the sheet, i.e. with sheets comprising ten rows, ten bundles of bank-notes are produced. Therefore, it is only necessary for the last cutting unit to operate with a relatively slow cutting movement.

The apparatus according to the invention takes into account the general tendency of using sheets with an ever-increasing number of notes, because with the same operating speed of the banding devices, the number of bound produced automatically increases with the number of notes per row on the sheet.

BRIEF DESCRIPTION OF DRAWING

The invention is described in detail hereafter with reference to the accompanying drawing, which is a diagrammatic perspective view of an installation in accordance with the invention.

DESCRIPTION OF PREFERRED EMBODIMENTS

According to this drawing, in which only the components necessary for understanding the invention are shown, a feed device 1 for sheets is provided, which receives the pile of sheets 2 for the purpose of supplying the latter to the cuting station. The piles of sheets, which normally contain one hundred sheets and are formed at the outlet of the numbering machine (not shown) may either be supplied manually or are conveyed automatically one after the other by means of a conveying device from the outlet of the numbering machine to the feed device 1. It is assumed hereafter that each sheet of bank-notes comprises twenty eight individual notes, which are arranged in seven rows each with four printed bank-notes located side-by-side.

The piles of sheets 2 are supplied in the direction of the arrow on a feed path to two longitudinal cutting units 3 and 4 with two parallel cutters located in the feed direction, which simultaneously cut the side edges of the sheet on both longitudinal sides of each pile of sheets. The piles of sheets then pass in the direction of the arrow to a transverse cutting unit 5 with a cutter arranged at right-angles to the feed direction, which firstly makes a cut on the edge of the front side of each pile of sheets, then divides the pile of sheets into bundle strips stepwise and finally carries out a fourth cut on the edge of the rear side of the last bundle strip. In the example in question, seven bundle strips 6 are produced from each pile of sheets, which strips are conveyed on a feed path one after the other to a banding station 7, which in the example in question has four banding devices *7a, 7b, 7c* and *7d* located one beside the other in a row. All the banding devices operate simultaneously, so that in this station, each bundle strip is surrounded with bands 8 at the four bank-note positions. The finished bound bundle strips 9 are then moved in their longitudinal direction, as indicated by an arrow, out of the region of the banding station 7 onto a feed path 10, on which they are once more moved in the original direction, according to the arrows. At the beginning of the feed path 10, at the outer corner of the latter, a counter 11 is provided which counts the individual sheets of each bound bundle strip, for the purposes of control. This counting can be carried out with a high degree of reliability, because the strips are surrounded securely by several bands. If required, necessary labels may also be applied to the individual bands on the feed path 10.

The bound bundle strips 9 are then moved on a table surface 12 and seven bundle strips located side-by-side then arrive, at right-angles to the previous feed direction, in the last cutting unit 13, which comprises a cutter extending at least over all the bundle strips. All seven strip bundles are then cut simultaneously and stepwise with this cutter into individual, already bound bundles of bank-notes, whereby in the example in question, seven bundles of bank-notes and four bundles of bank-notes per bundle strip are produced at the time of each cutting operation. The rows of finished cut bundles of bank-notes 14 are placed by tongs for example, in the direction of the arrow, on a discharge conveying device 15, on which they are once more moved in the direction of the original feed movement, as indicated by an arrow. Further processing of these bound bundles of bank-notes to form packs of bundles may take place as desired in various ways and in particular, as mentioned in the introduction, depends on whether packs of bundles with or without sequential numbers are desired and on whether bundles containing previously marked faults must be eliminated and replaced by satisfactory bundles. However, irrespective of the type and method of this possible further processing operation, the afore-described apparatus according to the invention can always be used, which supplies finished bound bundles of bank-notes.

Discharge chutes are provided at the cutting units 3,4 and 5, which cut the edges of the notes, which chutes allow the waste strip to fall in an unhindered manner onto a central conveyor belt.

For the cutting unit 4, the drawings show a waste strip 16, the conveyor belt 17 and a waste container 18 for receiving the waste material.

The banding devices *7a* to *7d* may be mounted to move longitudinally in order to locate the bands in a staggered manner with respect to the centre of the bundle of bank-notes, if necessary. In order to compensate for varying thicknesses due to unequal distribution of the die-stamping printing over the surface of the bank-note, at the time of the subsequent formation of packs of bundles, a turning station is appropriately located behind the last cutting unit 13, which rotates each secnd bundle of bank-notes through 180°.

As mentioned in detail in the introduction to the description, the main advantage of the apparatus according to the invention consists in that in comparison with known apparatus of this type, the output is substantially increased, without it being necessary to increase the operating speed of the individual cutting units and banding devices. On the contrary, the banding devices and the last cutting unit, in comparison with the afore-described known apparatus, can be operated at a slower working rhythm. the transverse cutting unit 5 and the banding station 7 naturally operate in the same cycle, which can appropriately amount to approximately four seconds. Under otherwise similar operating conditions, the working cycle of the last cutting unit naturally depends on the number of bundle strips to be cut simultaneously and is generally in the order of aproximately four seconds or of a longer period of time. With the apparatus according to the invention, it is naturally possible to convert sheets with any number and arrangement of individual notes, only the number of banding devices in the banding station 7 depending on the number of bank-notes per row and the length of the cutter of the last cutting unit 13 being selected according to the number of bundle strips to be divided simultaneously. Thus the apparatus can advantageously be designed with reference to the maximum useful format of sheet, on which fourteen rows each with eight bank-notes can be provided, i.e. the apparatus may comprise eight banding stations and can be set up for a maximum of fourteen bundle strips per pile of sheets.

Simultaneously cutting of the two edges of the sheet arranged in the feed direction, by the first two longitudinal cutting units 3 and 4 simplifies the operation and eliminates the necessity of the last cutting unit 13 having to carry out a further cut on the edge of the notes. Advantageously, all four cutting units in the apparatus according to the invention can be constructed in a completely identical manner. As regards the banding devices and cutting units as well as the individual conveying devices, the latter may be known components, so that the latter do not need to be described in detail.

What is claimed is:

1. Apparatus for converting piles of freshly printed sheets of bank-notes, each sheet bearing a plurality of rows of bank-notes with a plurality of bank-notes in each row, into bundles of individual bank-notes with each bundle surrounded by a band, comprising:

first cutting means for making a plurality of parallel cuts across a pile of sheets of bank-notes to divide said pile of sheets into a plurality of bundle strips with each strip containing a plurality of bank-notes juxtaposed end-to-end, banding means for applying to each of said bundle strips a plurality of bands equal in mumber to the number of bank-notes in each strip, said banding means comprising a plurality of banding units disposed side-by-side and equal in number to the number of bank-notes in each strip, said banding units being operated simultaneously and being positioned to apply a band at the location of each bank-note in a strip, and second cutting means for cutting each of said bundle strips into bundles of individual bank-notes, each of said bundles being banded by a band applied by said banding means prior to the cutting of said bundle strips by said second cutting means.

2. Apparatus according to claim 1, comprising means for feeding a plurality of said banded bundle strips to said second cutting means in a direction perpendicular to their length to assemble them in registered side-by-side position at said second cutting means, said second cutting means comprising means for cutting all of said plurality of bundle strips simultaneously.

3. Apparatus according to claim 2, in which said feeding means comprises means for feeding all of the bundle strips from one pile of sheets of bank-notes to said cutting means for cutting all of said bundle strips simultaneously.

4. Apparatus according to claim 3, in which said second cutting means comprises means for intermittently moving said plurality of bundle strips endwise with said bundle strips disposed side-by-side and means for sequentially cutting across all of said bundle strips between bank-notes, said cutting being effected across all of said bundle strips simultaneously.

5. Apparatus according to claim 2, comprising means for conveying said bundle strips from said first cutting means to said banding means along a path at right angles to the length of said bundle strips.

6. Apparatus according to claim 2, in which said banding units are adjustable in position lengthwise of said bundle strips to position the bands at selected positions.

7. Apparatus according to claim 1, further comprising third cutting means located in advance of said first cutting means and comprising two spaced parallel cutters positioned to trim opposite side edges of said pile of sheets of bank-notes before said sheets are fed to said first cutting means.

8. apparatus according to claim 7, comprising means for feeding said bundle strips in a direction perpendicular to their length from said first cutting means to said banding means, feeding said banded bundle strips lengthwise from said banding means to an intermediate position and feeding said banded bundle strips in a direction perpendicular to their length from said intermediate position to said second cutting means.

9. A process for converting piles of freshly printed sheets of bank-notes, each sheet bearing a plurality of rows of bank-notes with a plurality of bank-notes in each row, into bundles of individual bank-notes with each bundle surrounded by a band, comprising:

a first cutting operation which comrises making a plurality of parallel cuts across a pile of sheets of bank-notes to divide said pile of sheets into a plurality of bundle strips, with each strip containing a plurality of bank-notes juxtaposed end-to-end, a banding operation which comprises applying simultaneously to each of said bundle strips a plurality of bands equal in number to the number of bank-notes in each strip, said bands being positioned to apply a band at the location of each bank-note in a strip, and thereafter a second cutting operation which comprises cutting each of said bundle strips into bundles of individual bank-notes, each of said bundles being banded by a band applied in said banding operation prior to the cutting of said bundle strips by said second cutting operation.

10. A process according to claim 9, in which a plurality of bundle strips are assembled into registered side-by-side position and all of said bundle strips thus assembled are cut simultaneously in said second cutting operation.

11. A process according to claim 10, in which all of the bundle strips from one pile of sheets of bank-notes are assembled into registered side-by-side position and are cut simultaneously in said second cutting operation.

12. A process according to claim 10, in which said plurality of bundle strips assembled in side-by-side position are cut into bundles of individual bank-notes by intermittently moving said assembled bundle strips in a direction lengthwise of said bundle strips and sequentially cutting across all of said bundle strips between bank-notes in said second cutting operation, said cutting being effected across all of said bundle strips simultaneously.

13. A process according to claim 9, in which said bundle strips produced by said first cutting operation are moved along a path at right angles to the length of said bundle strips to a position for said banding operations.

14. A process according to claim 9, in which prior to said first cutting operation, opposite side edges of said pile of sheets of bank-notes are simultaneously trimmed.

15. A process for converting piles of freshly printed sheets of bank-notes, each sheet bearing a plurality of rows of bank-notes with a plurality of bank-notes in each row, into bundles of individual bank-notes with each bundle surrounded by a band, comprising:

at a first cutting station intermittently moving a pile of sheets of bank-notes in a direction perpendicular to rows of bank-notes on said sheets and sequentially making a plurality of cuts across said pile of sheets to cut said pile of sheets between rows of bank-notes and thereby divide said pile of sheets into a plurality of bundle strips, with each strip containing a plurality of juxtaposed end-to-end bank-notes, sequentially moving said resulting bundle strips in a direction perpendicular to their length from said first cutting station to a banding station, at said banding station applying simultaneously to each of said bundle strips a plurality of bands equal in number to the number of bank-notes in each strip, said bands being positioned to apply a band at the location of each bank-note in a strip, sequentially moving the banded bundle strips from said banding station in a direction lengthwise of said bundle strips and then moving said banded bundle strips in a direction perpendicular to their length to assemble a plurality of said banded bundle strips in registered side-by-side position at a second cutting station, and at said second cutting station moving said plurality of assembled side-by-side bundle strips in a direction lengthwise of said bundle strips and sequentially making a plurality of cuts across all of said assembled banded bundle strips, said cuts being made between bank-notes in a strip, to divide said banded bundle strips into bundles of individual bank-notes, each of said bundles being banded by a band applied at said banding station.

16. A process according to claim 15, in which all of the bundle strips from a pile of sheets of bank-notes are assembled in registered side-by-side position at said second cutting station and are simultaneously cut.

17. A process according to claim 15, in which at a trimming station in advance of said first cutting station opposite side edges of said pile of sheets of bank-notes are simultaneously trimmed, whereupon said trimmed pile of sheets is moved to said first cutting station.

* * * * *